US005525410A

United States Patent [19]

Hansen

[11] Patent Number: 5,525,410

[45] Date of Patent: Jun. 11, 1996

[54] PRESS FABRIC

[75] Inventor: Robert A. Hansen, Averill Park, N.Y.

[73] Assignee: Albany International Corp., Albany, N.Y.

[21] Appl. No.: 393,715

[22] Filed: Feb. 24, 1995

[51] Int. Cl.[6] ..... D03D 3/00

[52] U.S. Cl. ..... 428/229; 139/383 A; 139/426 R; 428/225; 428/234; 428/257

[58] Field of Search ..... 139/383 A, 426 R; 428/229, 257, 258, 259, 225, 234

[56] References Cited

U.S. PATENT DOCUMENTS

| | | | |
|---|---|---|---|
| 4,533,594 | 8/1985 | Buchanan | 428/236 |
| 4,739,803 | 4/1988 | Borel | 139/383 |
| 4,776,373 | 10/1988 | Borel | 139/383 |
| 4,958,673 | 9/1990 | Dufour | 162/358 |
| 5,087,327 | 2/1992 | Hood | 162/358 |
| 5,094,719 | 3/1992 | Fry | 162/358 |
| 5,103,874 | 4/1992 | Lee | 139/383 |
| 5,104,724 | 4/1992 | Hsu | 428/222 |
| 5,117,865 | 6/1992 | Lee | 139/383 |
| 5,164,249 | 11/1992 | Tyler et al. | 428/225 |
| 5,167,261 | 12/1992 | Lee | 139/383 |
| 5,188,884 | 2/1993 | Smith | 428/193 |
| 5,194,121 | 3/1993 | Taguchi et al. | 162/358 |
| 5,199,467 | 4/1993 | Lee | 139/383 |
| 5,277,967 | 1/1994 | Zehle et al. | 428/234 |

*Primary Examiner*—James J. Bell
*Attorney, Agent, or Firm*—Kane, Dalsimer, Sullivan, Kurucz, Levy, Eisele and Richard

[57] ABSTRACT

A papermaker's fabric for the press section of a papermachine is woven from a multistrand yarn composed of filaments having diameters in the range from 0.04 mm to 0.18 mm. The multistrand yarn may be used singly or plied. The filaments are in a diameter range between those traditionally used for multifilament yarns and monofilament yarns. The fabrics woven from the multistrand yarns have compressibilities of fabrics woven from multifilament yarns and the cleanliness and openness of fabrics woven from monofilament yarns.

7 Claims, No Drawings

PRESS FABRIC

BACKGROUND OF THE INVENTION

1. Field of the Invention

The present invention relates to the papermaking arts. More specifically, the present invention is a papermaker's fabric for use in the press section of the papermachine, such a fabric being commonly referred to as a press fabric.

2. Description of the Prior Art

During the papermaking process, a fibrous web is formed by depositing a fibrous slurry on a forming fabric in the forming section of a papermachine. A large amount of water is drained from the slurry during this process, leaving the fibrous web on the surface of the forming fabric.

The newly formed web proceeds from the forming section to a press section, which includes a series of press nips. The fibrous web passes through the press nips supported by a press fabric, or, as is often the case, between two such press fabrics. In the press nips, the fibrous web is subjected to compressive forces which squeeze water therefrom. The water is accepted by the press fabric or fabrics and, ideally, does not return to the web.

The web finally proceeds to a drying section, which includes at least one series of rotatable dryer drums or cylinders, heated from within by steam. The web is directed in a sinuous path sequentially around each in the series of drums by a dryer fabric, which holds the web closely against the surfaces of the drums. The heated drums reduce the water content of the web to a desirable level through evaporation.

The press fabrics used to clothe the press section are crucial components in the paper manufacturing process. One of their functions is to support and to carry the paper product being manufactured through the press nips. In this respect, the fabric serves as a conveyor belt during the manufacturing process.

The press fabrics also take part in the finishing of the surface of the paper sheet. That is, the surface of the press fabric is designed to be smooth and uniformly resilient, so that, in the course of passing through the press nips, a smooth, mark-free surface is imparted to the paper.

Perhaps most importantly, the press fabrics accept the large quantities of water extracted from the wet paper in the press nip. In order to fill this function, there literally must be somewhere in the fabric for the water to go, and the fabric must have an adequate permeability to water for its entire useful life.

Contemporary press fabrics are available in a wide variety of styles designed to meet the requirements of the papermachines on which they are installed for the paper grades being manufactured. Generally, they comprise a woven base fabric into which has been needled a batt of fine, nonwoven fibrous material. The base fabrics may be woven from monofilament, plied monofilament, multifilament or plied multifilament yarns, and may be single-layered, multi-layered, or multi-plied.

The yarns are typically extruded from any one of the synthetic polymeric resins, such as polyamide and polyester resins, used for this purpose by those of ordinarily skill in the papermachine clothing arts. Monofilament yarns may be used either singly or, as implied above, in a plied bundle comprising three or more monofilaments and having a minimal twist to hold the monofilaments together. Individual monofilaments typically have diameters over 0.18 mm.

Multifilament yarns may also be used singly or in a plied bundle of three or more individual multifilament yarns. A single multifilament yarn is composed of a great number of individual filaments of small diameter, typically less than 0.04 mm. The filaments are twisted together to some degree to impart integrity to the multifilament yarn. In a plied multifilament yarn, three or more multifilament yarns are twisted minimally about one another to hold the multifilaments together.

Base fabrics woven from monofilament or plied monofilament are open, providing ample void volume for the temporary storage of water pressed from the paper sheet, and relatively incompressible because of the stiffness of the monofilament. On the other hand, those woven from multifilament or plied multifilament are compressible, because of the thinness of the individual filaments making up the multifilament yarns, and tend to become compacted during use on the papermachine, with the result that they lose openness and void volume.

In each case, the yarns themselves to some extent block the passage of water through the base fabric. Where monofilaments are used, the blockage occurs because of the relative thickness of the yarns. Where multifilaments are used, the blockage occurs because the individual filaments in the multifilament yarns are so thin that they clump together with little space therebetween for the passage of water. In each case, water must pass around the yarns, rather than through them, to drain or pass through the base fabric. The result may be marking of the paper sheet caused by an uneven pressure distribution.

The present invention provides a solution to these problems in the press fabrics of the prior art.

SUMMARY OF THE INVENTION

The papermaker's fabric of the present invention is a press fabric comprising a base fabric woven from yarns in the longitudinal and transverse directions, or in the machine and cross-machine directions, respectively, wherein the yarns in one of said directions are multistrand yarns assembled from filaments having diameters in the range from 0.04 mm to 0.18

As may be noted, the filaments used to make the multistrand yarns for the present invention have diameters which fall between those used in the prior art as filaments for multifilament yarns and as monofilaments.

As a consequence, the papermaker's fabrics of the present invention have characteristics falling between those woven from plied monofilament and plied multifilament yarns.

DETAILED DESCRIPTION OF THE PREFERRED EMBODIMENTS

The present invention is a papermaker's fabric for the press section of a papermachine. The papermaker's fabric is woven using multistrand yarns composed of individual filaments having diameters in the range from 0.04 mm to 0.18 mm. The multistrand yarn may be used in either the machine direction (MD) or cross-machine direction (CD), or in both directions, of the fabric. Further, the multistrand yarn may be used singly or in a plied form.

A press fabric woven from multistrand yarns of this type has compressibility characteristics between those for press fabrics woven from plied monofilament and plied multifilament yarns. This is because the present multistrand yarns have a stiffness falling between those for plied monofilament and multifilament yarns. In addition, the present multistrand yarns permit water to pass more readily through the fabric structure, as water may pass through the yarns as well as around them. As noted above, that water may only flow around monofilament and multifilament yarns was a shortcoming of the press fabrics of the prior art. The present multistrand yarns provide a papermaker's fabric with a reduced marking tendency, and a more uniform pressure distribution to the paper sheet.

The multistrand yarns may comprise filaments of any of the synthetic polymeric resins used by those skilled in the art to make yarns for papermachine clothing, such as polyamide, polyester and polyurethane. That is to say, the multistrand yarns may comprise filaments of a polymeric resin selected from the group consisting of polyamides and polyurethanes and copolymers thereof, polyesters and polyurethanes and copolymers thereof, polyaramids, polyimides, polyolefins, polyetherketones, polypropylene, polyethylene terephthalate (PET) and polybutylene terephthalate (PBT). The press fabrics woven from the multistrand yarns may be woven endless, or flat woven and joined, or made, into endless form with a woven seam, butt seam, lapped seam, or with other techniques known in the art for placing fabrics into endless form.

Other benefits following from the use of the present multistrands, compared to using plied monofilaments or plied multifilaments, in the weaving of press fabrics include a superior pliability for ease of installation. Further, there is an improved stacking of yarns with multilayer weaves, particularly in the warp direction, compared to that obtained with plied multifilament.

When compared to prior-art fabrics woven from plied multifilaments, the present papermaker's fabrics display a superior retention of air and water permeability. Finally, the present fabrics have the compressibility of those woven from multifilaments with the openness of those woven from monofilaments. This provides the papermaker's fabrics of the present invention with an improved cleanability.

The press fabrics of the present invention may be produced in any weave pattern, and in any weave density. They may be woven endless, flat woven and seamed into endless form, or manufactured by a spiral technique. The press fabrics may also be of a laminated construction wherein a plurality of woven layers are joined into a composite structure. Any number of layers may be included in such a structure.

The press fabrics of the present invention may be used in the manufacture of paper in all grades, such as kraft, printing papers, newsprint, tissue, board, and so forth.

Modifications to the above would be obvious to those of ordinary skill in the art, yet would not bring the invention so modified beyond the scope of the appended claims.

What is claimed is:

1. In a papermaker's fabric for the press section of a papermaking or similar machine, said papermaker's fabric being woven from yarns in longitudinal, or machine, and transverse, or cross-machine, directions, the improvement comprising:

a multistrand yarn in both of said longitudinal and transverse directions, said multistrand yarn comprising a plurality of filaments twisted together, said filaments having diameters in the range from 0.04 mm to 0.18 mm.

2. In a papermaker's fabric as improved in accordance with claim 1, a multistrand yarn comprising a plurality of plied bundles of filaments twisted together.

3. In a papermaker's fabric as improved in accordance with claim 1, a multistrand yarn comprising filaments of a polymeric resin selected from the group consisting of polyamides and polyurethanes and copolymers thereof, polyesters and polyurethanes and copolymers thereof, polyaramids, polyimides, polyolefins, polyetherketones, polypropylene, polyethylene terephthalate (PET) and polybutylene terephthalate (PBT).

4. In a papermaker's fabric as improved in accordance with claim 1, a multistrand yarn comprising filaments of a polyamide resin.

5. In a papermaker's fabric as improved in accordance with claim 1, a multistrand yarn comprising filaments of a polyester resin.

6. In a papermaker's fabric as improved in accordance with claim 1, a multistrand yarn comprising filaments of a polyurethane resin.

7. A papermaker's fabric as claimed in claim 1 wherein said multistrand yarn is a plied multistrand yarn.

* * * * *